US007163605B2

(12) United States Patent
Chen

(10) Patent No.: US 7,163,605 B2
(45) Date of Patent: Jan. 16, 2007

(54) BRA STORING CASE

(76) Inventor: David E. Chen, 20912 Granite Wells Rd., Walnut, CA (US) 91789

( * ) Notice: Subject to any disclaimer, the term of this patent is extended or adjusted under 35 U.S.C. 154(b) by 211 days.

(21) Appl. No.: 10/865,648

(22) Filed: Jun. 10, 2004

(65) Prior Publication Data

US 2005/0224376 A1 Oct. 13, 2005

(51) Int. Cl.
*B65D 85/18* (2006.01)

(52) U.S. Cl. ..... 202/292; 206/278

(58) Field of Classification Search ..... 206/278, 206/292; 223/84

See application file for complete search history.

(56) References Cited

U.S. PATENT DOCUMENTS

| | | | | |
|---|---|---|---|---|
| 2,951,621 | A * | 9/1960 | Cheney | 223/66 |
| 3,190,435 | A * | 6/1965 | Schlanger | 206/278 |
| 3,837,476 | A * | 9/1974 | Schwartz | 206/45.24 |
| 5,556,013 | A * | 9/1996 | Mayer | 223/84 |
| 5,592,775 | A * | 1/1997 | Dew | 47/61 |
| 5,829,083 | A * | 11/1998 | Sutton | 8/150 |
| 6,220,442 | B1 * | 4/2001 | Merrell et al. | 206/721 |
| 6,231,424 | B1 | 5/2001 | Valentin | |
| 6,471,102 | B1 * | 10/2002 | Hancock | 223/84 |
| 6,742,683 | B1 * | 6/2004 | Phan | 223/84 |
| 6,758,720 | B1 | 7/2004 | Chen | |
| 6,761,291 | B1 * | 7/2004 | Moskovitz et al. | 223/84 |
| 6,780,081 | B1 | 8/2004 | Chen et al. | |
| 2001/0007308 | A1 * | 7/2001 | Glassman | 206/469 |
| 2003/0057118 | A1 * | 3/2003 | Coppedge et al. | 206/278 |
| 2003/0073378 | A1 * | 4/2003 | Davis | 450/88 |

* cited by examiner

*Primary Examiner*—Sue A. Weaver
(74) *Attorney, Agent, or Firm*—Christie, Parker & Hale, LLP.

(57) ABSTRACT

A bra storing case comprises a left casing and a right casing, which each have respectively a breast contour concave, which are symmetrical to each other for storing breast cups. Inner sides of the left and right casings are connected together to form a foldable shape. When the bra storing case is folded, the interior surfaces of the stored breast cups are covered completely. Lateral sides of the left and right casings have disposed thereon a clasping means. After being folded, the left and right casings are clasped by the clasping means, and the breast contour concaves protrude outward from the exterior surfaces of the left and right casings. The case structure is applicable to storing and placing the strapless, backless bra cups.

10 Claims, 8 Drawing Sheets

BRA STORING CASE

CROSS-REFERENCE TO RELATED APPLICATIONS

This application claims the priority of Taiwan Patent Application No. 093205313, filed Apr. 7, 2004 and China Patent Application No. 200420008954.9, filed Apr. 13, 2004.

FIELD OF THE INVENTION

The present invention is related to a bra storing case, and in a particular embodiment to a foldable bra storing case, composed of a left and a right casing, which respectively have a breast contour concave. After the left and right casings are folded, the breast contour concaves that protrude outward the exterior surfaces of the left and right casings could provide a way to store strapless, backless breast cups. The mold of the present invention in certain embodiments is light, handy and takes up less space. The structure of the case is suitable for storing and packing the strapless, backless bra cups.

DESCRIPTION OF THE PRIOR ART

The traditional styles of bras mostly have shoulder straps and back straps for female wearers to stabilize and lift their breasts. It has the effects of elegant appearance, protecting breasts, and preventing sagging. However the shoulder and back straps will reduce the elegant looking when females dress in evening gowns, off-the-shoulder dresses, or backless gowns. Thus, people keep on searching for new strapless and backless bra cups for women to fit different styles of bras. For example, U.S. Pat. No. 6,231,424 "Strapless and backless bra" to Valentin discloses a strapless and backless bra for females to wear. The inventor of the present invention also invented a strapless and backless bra, which includes a pair of bra cups and a connector. See U.S. Pat. Nos. 6,758,720 and 6,780,081, both of which are incorporated herewith by reference. The bra cups are in breast molding formed by an amount of silicon gel encased in thermoplastic film material. Substantially the entire interior surface of each of the bra cups has spread over it a layer of pressure sensitive adhesive. The pressure sensitive adhesive layer can be reusable and suitable for fixing the bra to a wearer's breast appropriately. The connector is disposed between inner sides of each of the breast cups and makes the pair of bra cups able to be put together or separated from each other. Because of the reusable adhesive layer disposed on the interior surface of the strapless and backless bra, wearers can take off and wear the bra again, the bra cups taken off have to be placed in a case in order to prevent being polluted by dirt. A conventional shape of a receiving case is depicted as FIG. 1. The receiving case 90 has a rectangular case body 91 and a cover body 92. The case body 91 is provided with a pair of concaves 93. Whereby a pair of bra cups 95 of the strapless and backless bra 94 could be placed in the pair of concaves 93. Then the cover body 92 is closed and could prevent dirt polluting the adhesive layer of the interior surfaces of the bra cups 95. However the size of the receiving case 90 is too big to carry with ease. Especially during a long trip, the receiving case 90 will occupy a large space within luggage.

In view of this, the inventor of the present invention provides in certain embodiments a bra storing case for storing a strapless, backless bra to eliminate one or more of the above stated defects.

SUMMARY OF THE INVENTION

The primary object of certain embodiments of the present invention is to provide a bra storing case including a pair of left and right casings. Once casings that are placed with the breast cups are folded to close up, the interior surfaces of bra would not be polluted by dirt.

The secondary object of certain embodiments of the present invention is to provide a bra storing case, which can be clasped and fixed by clasping means disposed on the lateral side of the left and right casings and that is simple to operate.

Another object of certain embodiments of the present invention is to provide a bra storing case, which can be opened or released from the clasping condition by extension portions or interlaced protrusions formed on the outer side of the left and right casings, and whose operation is simple.

Another object of certain embodiments of the present invention is to provide a bra storing case, which is light and has small size, takes up less space, and is convenient for being carried or stored.

To achieve the above objects, the bra storing case in certain embodiments includes a left casing and a right casing. Each of the left and right casings has respectively a breast contour concave that is symmetrical to each other for storing breast cups. Inner sides of the left and right casings are connected together to form a foldable shape. When the bra storing case is folded, the interior surfaces of the stored breast cups are covered completely. Lateral sides of the left and right casings have disposed thereon a plurality of corresponding clasping means. After being folded, the left and right casings are clasped by the clasping means. The breast contour concaves protrude outward the exterior surfaces of the left and right casings. The folded bra storing case can be placed on the dressing table directly and has an aesthetic appearance.

The clasping means can be a set of a clasping hole and an embedding portion and be engaged and fixed by an interference fit. The clasping hole and the embedding portion are respectively integrally formed with the left and right casings. The clasping means also can be designed as a set of a male clasp and a female clasp respectively to fit the left and right casings together.

Interlaced protrusions disposed on the lateral sides of the left and right casings or extension portions disposed outside the clasping means are provided for opening the left and right casings or releasing from the clasping condition.

The present invention will be apparent after reading the detailed description of the preferred embodiments thereof in reference to the accompanying drawings.

DETAILED DESCRIPTION OF THE INVENTION

Figure 1:
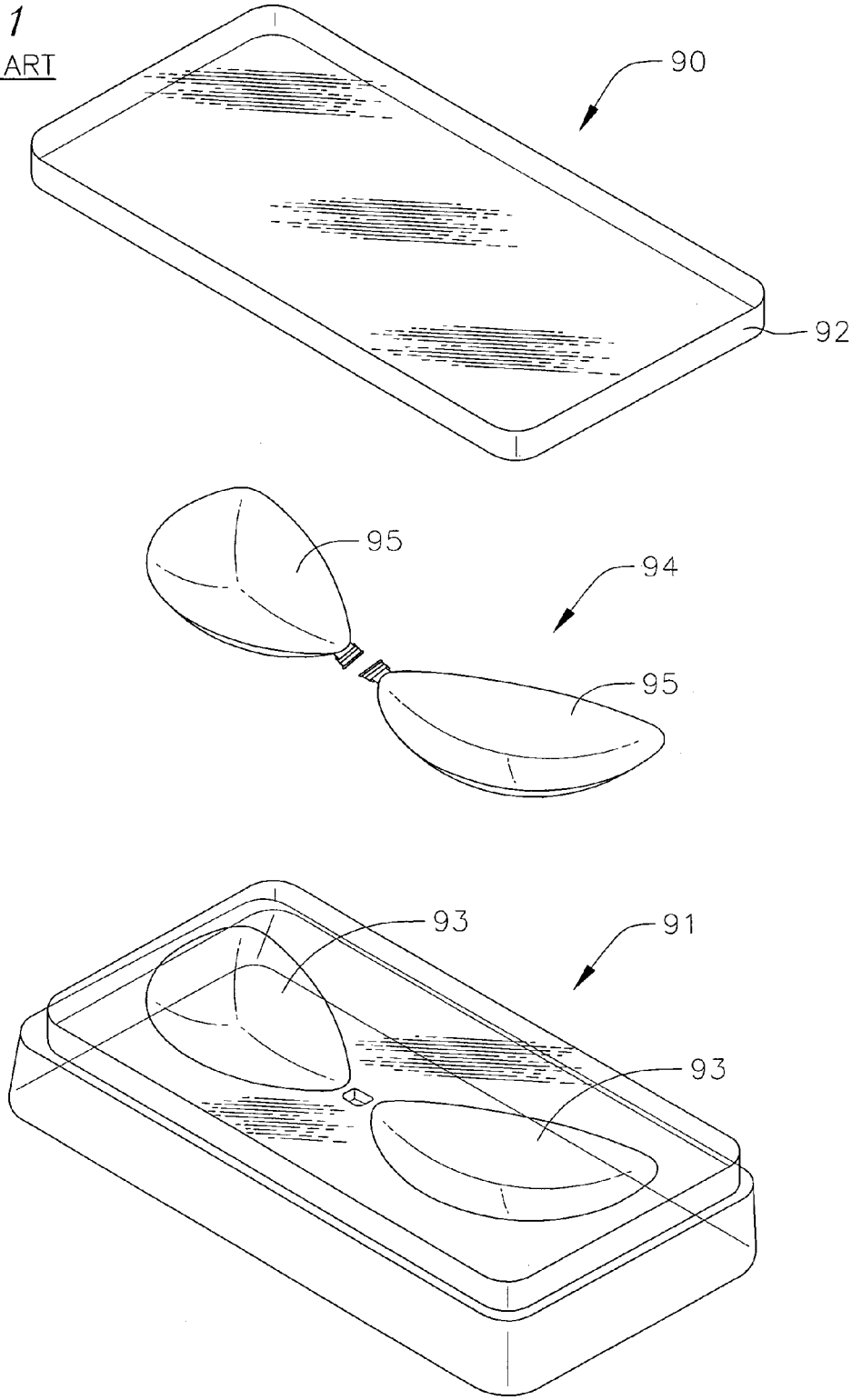
FIG.1 PRIOR ART
FIG. 1 is a perspective view of a conventional receiving case for storing strapless and backless bra.
Figure 2:
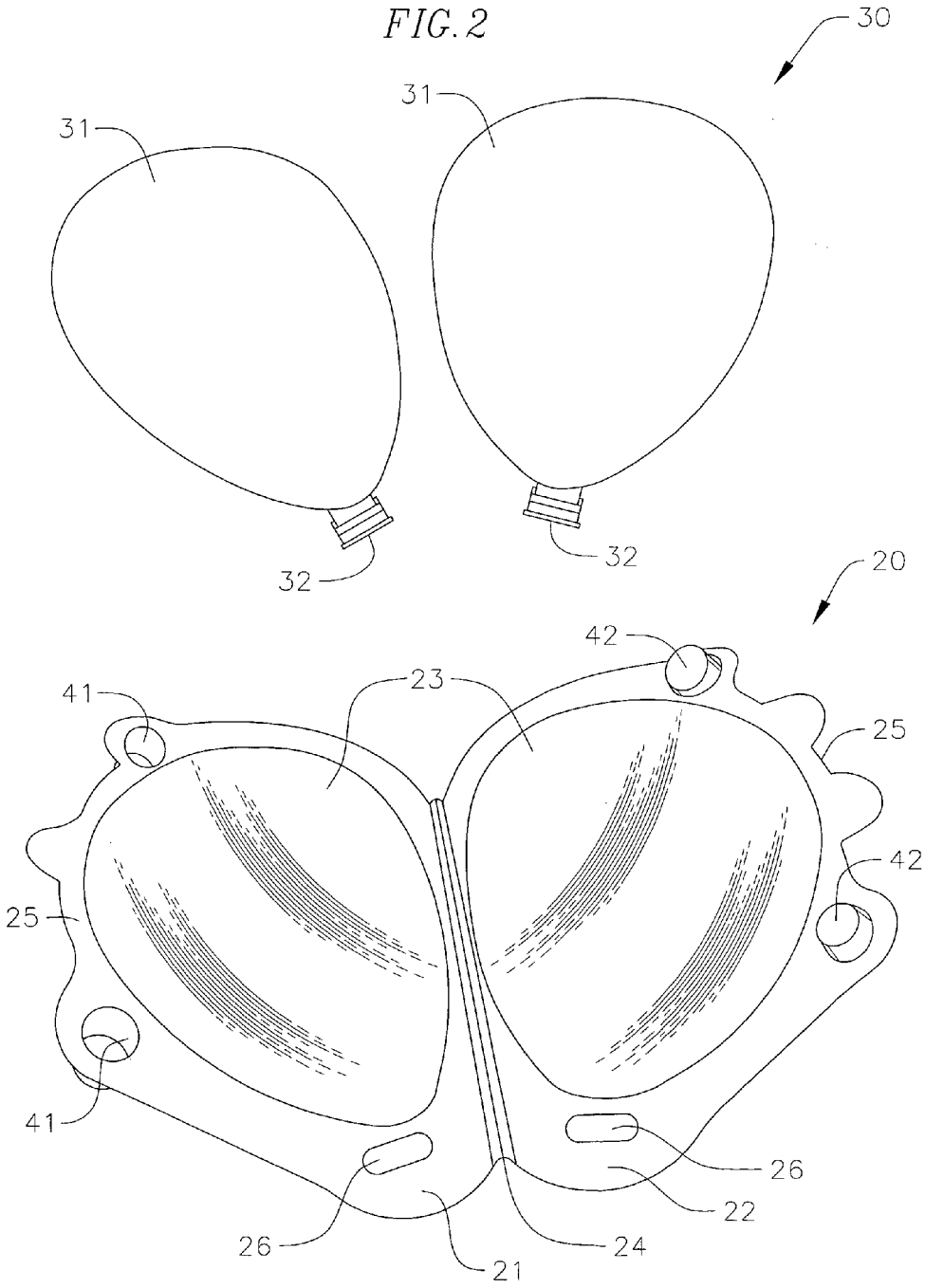
FIG. 2 is a schematic view of a bra storing case in unfolded condition according to one embodiment of the present invention.
Figure 3:
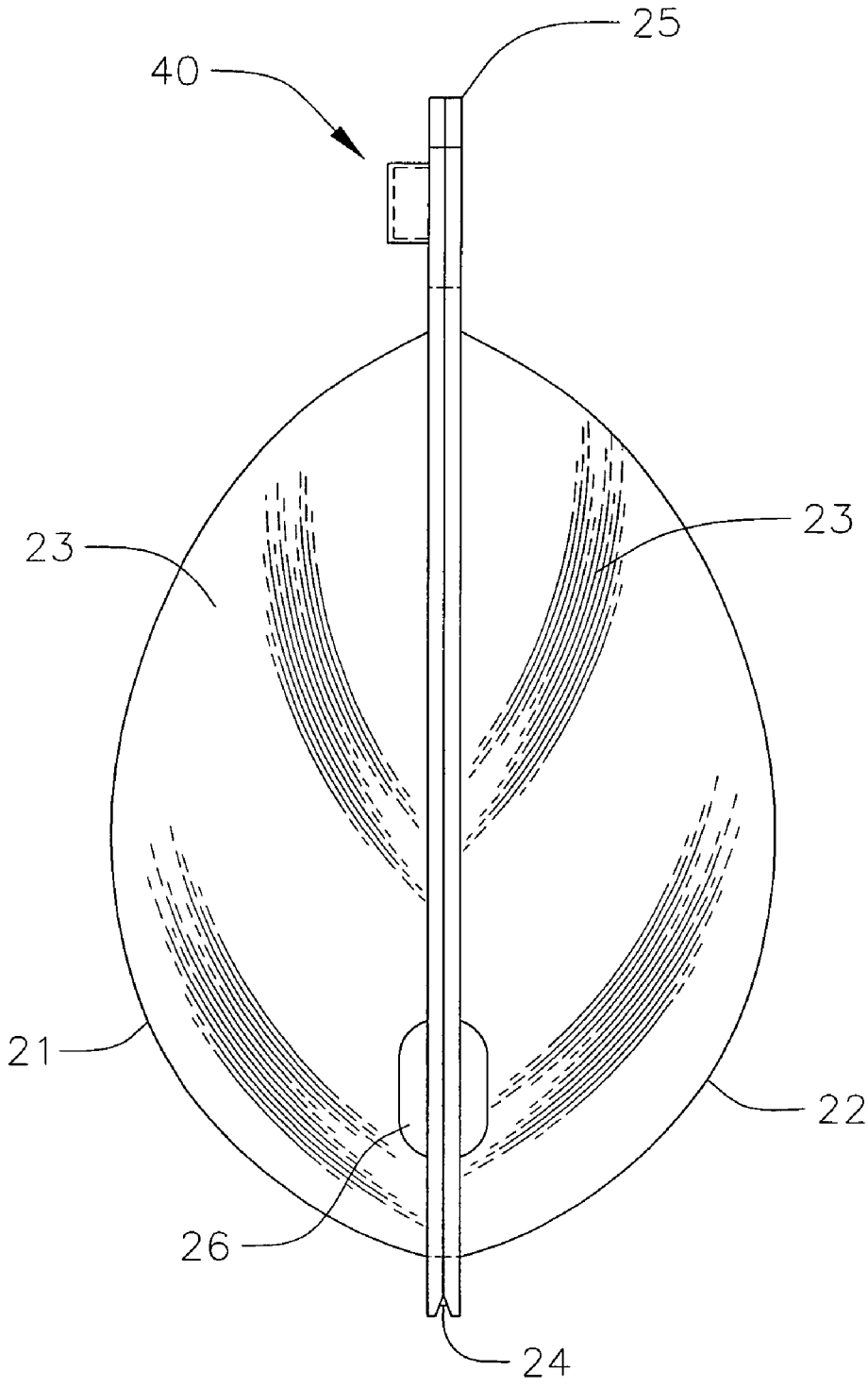
FIG. 3 is a schematic view of the bra storing case in folded and fixed condition according to one embodiment of the present invention.

Referring to FIG. 2 and FIG. 3, the bra storing case 20 of one embodiment of the present invention is a transparent plastic case including a left and a right casing 21,22. Each of them has respectively a breast contour concave 23 that is symmetrical to each other for storing breast cups 30. The breast cups 30 are a kind of strapless and backless bra, wherein substantially the entire interior surface 31 of each of the breast cups comprises a pressure sensitive adhesive layer thereon for adjoining the bra to the wearer's breast. At least a lateral chamber 26 is disposed next to the breast contour concave 23 for placing connectors 32 or accessories of breast cups 30, e.g. separable shoulder straps, back straps or pull-up devices.

Inner sides 24 of the left and right casings 21,22 are shown connected together to form a foldable shape. The connection between the left and right casings can be permanent or removable. Lateral sides 25 of the left and right casings 21,22 are shown having disposed thereon a plurality of corresponding clasping means 40, but a single clasping means can also be used. After being folded, the left and right casings 21,22 are clasped by the clasping means 40, and the breast contour concaves 23 protrude outward of the exterior surfaces of the left and right casings 21,22 to form a shell shape appearance of a main body of the storing case 20 as shown in FIG. 3. Whereby the interior surfaces 31 of the stored breast cups 30 are covered completely inside to prevent being contaminated by dirt or miscellaneous objects.

Figure 4A:
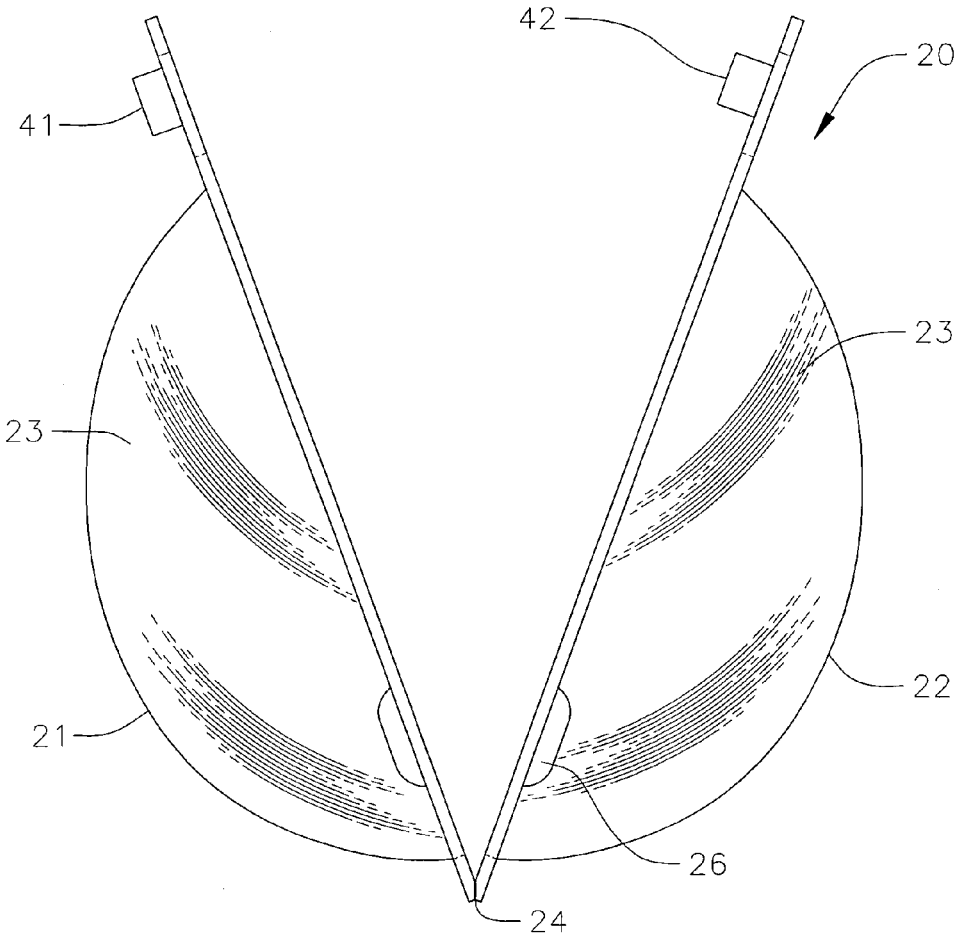
FIG. 4A is a side view of the bra storing case in unfolded condition, illustrating one embodiment of a clasping means.
Figure 4B:
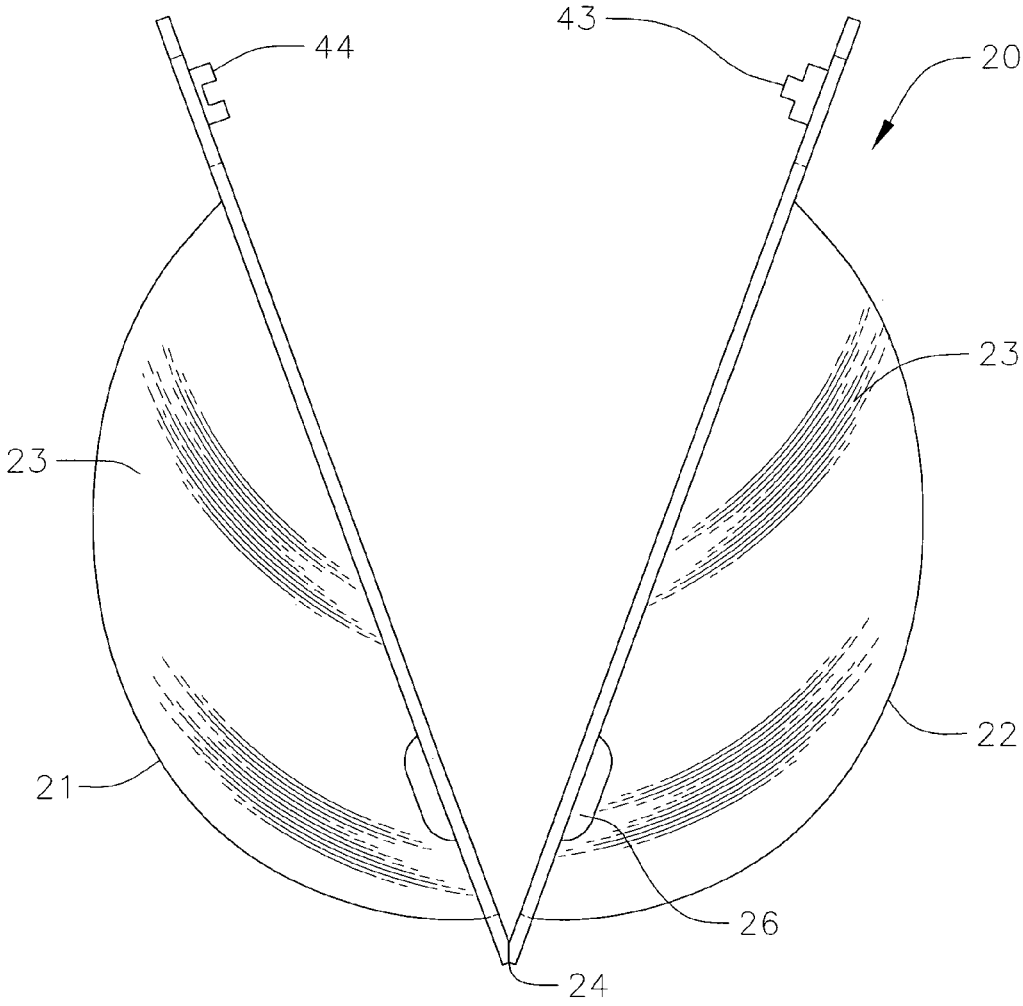
FIG. 4B is a side view of the bra storing case in unfolded condition, illustrating another embodiment of the clasping means.

Referring to FIG. 4A, one embodiment of the clasping means 40 includes a clasping hole 41 and an embedding portion 42, which are respectively integrally formed with the left and right casings 21,22, wherein the embedding portion 42 and clasping hole 41 are engaged with each other by an interference fit. Referring to FIG. 4B, another embodiment of the clasping means 40 includes a male clasp 43 and a female clasp 44, which are respectively disposed on the right casing 22 and the left casing 21. Whereby the male clasp 43 and female clasp 44 are engaged with each other to fix the left and right casings 21,22. The foregoing description of the preferred embodiments of this invention has been presented. It is not intended to be exhaustive or to limit the invention to the precise form disclosed, and obviously, many modifications and variations that may be apparent to a person skilled in the art are intended to be included within the scope of this invention.

Figure 5A:
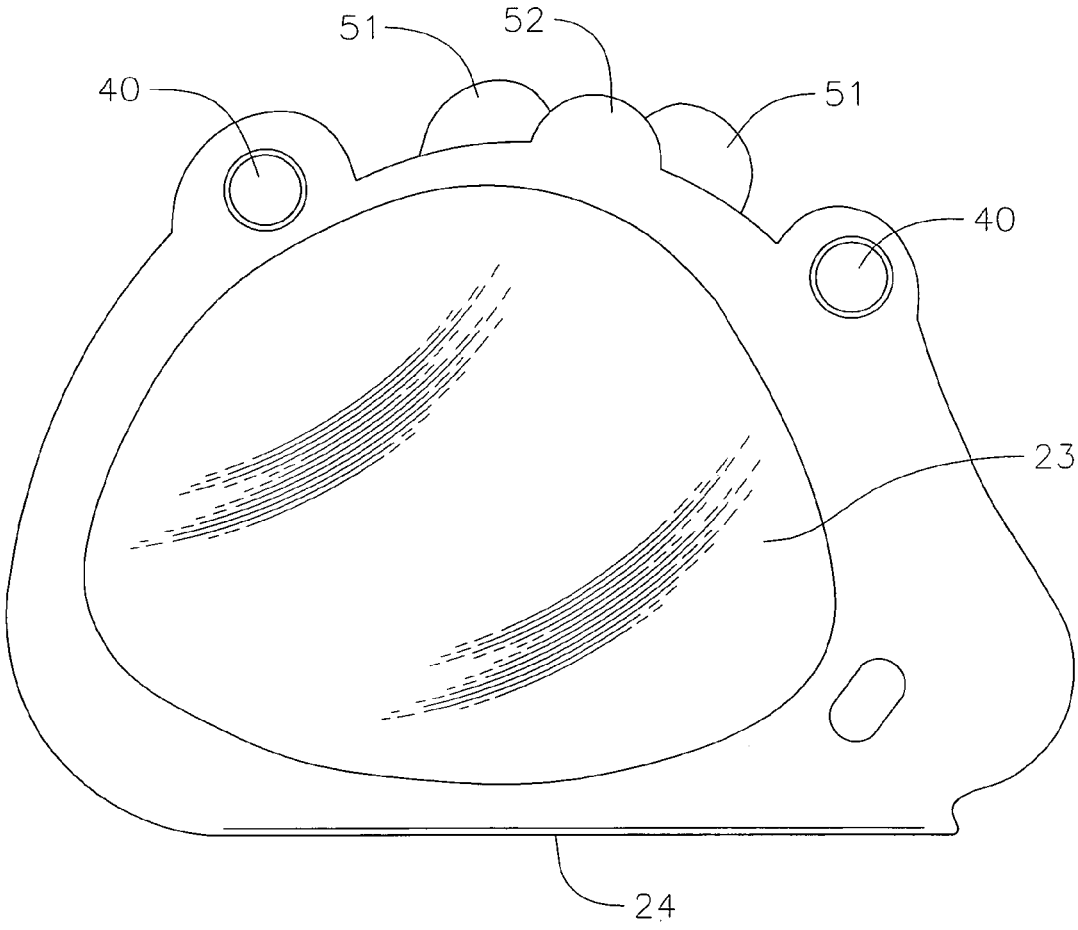
FIG. 5A is a front view of a left casing of the bra storing case in folded condition, illustrating protrusions, which are disposed at an interlaced position for separating the left and right casings.
Figure 5B:
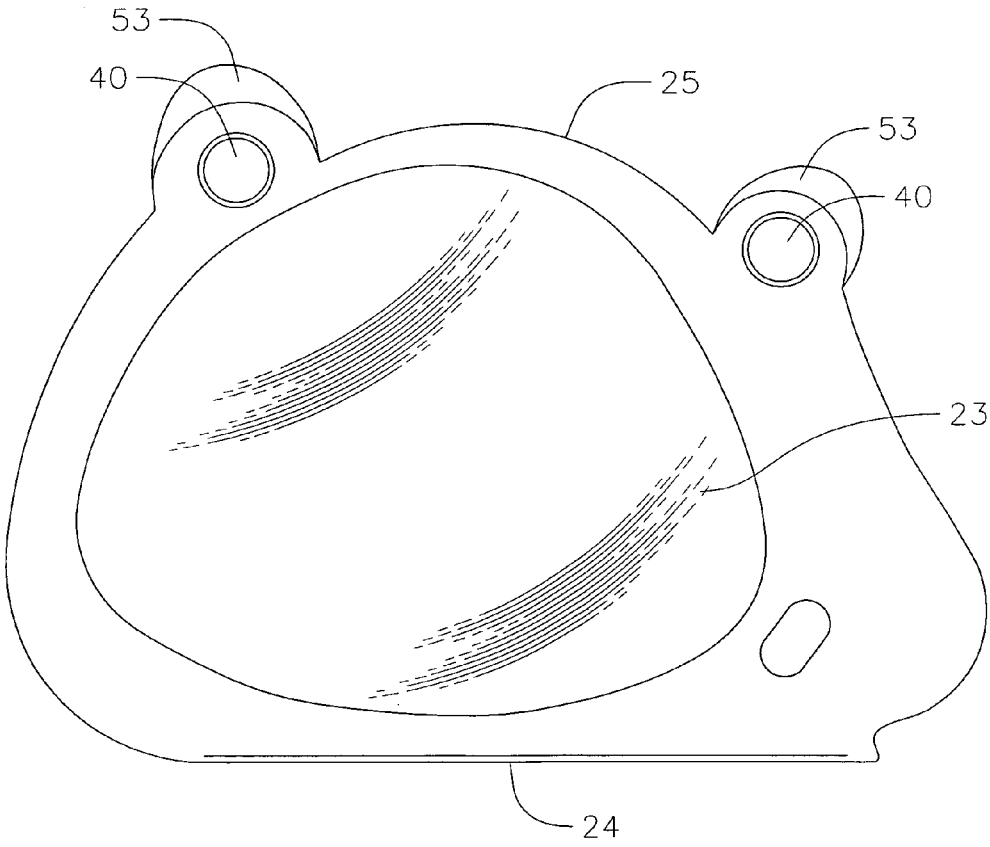
FIG. 5B is a front view of a left casing of the bra storing case in folded condition, illustrating extension portions, which are disposed on the outer side of the clasping means for separating the left and right casings.

Referring to FIG. 5A, lateral sides 25 of the left and right casings 21,22 respectively have interlaced protrusions 51,52 for separating the left and right casings 21, 22 or releasing clasping condition. Another embodiment is shown as FIG. 5B. The lateral side 25 about the clasping means 40 forms extension portions 53 for separating the left and right casings 21,22 or releasing clasping condition. The foregoing description of the preferred embodiments of the exerting portion for separating the left and right casing 21,22 has been presented. It is not intended to be exhaustive or to limit the invention to the precise form disclosed, and obviously, many modifications and variations that may be apparent to a person skilled in the art are intended to be included within the scope of this invention.

Figure 6:
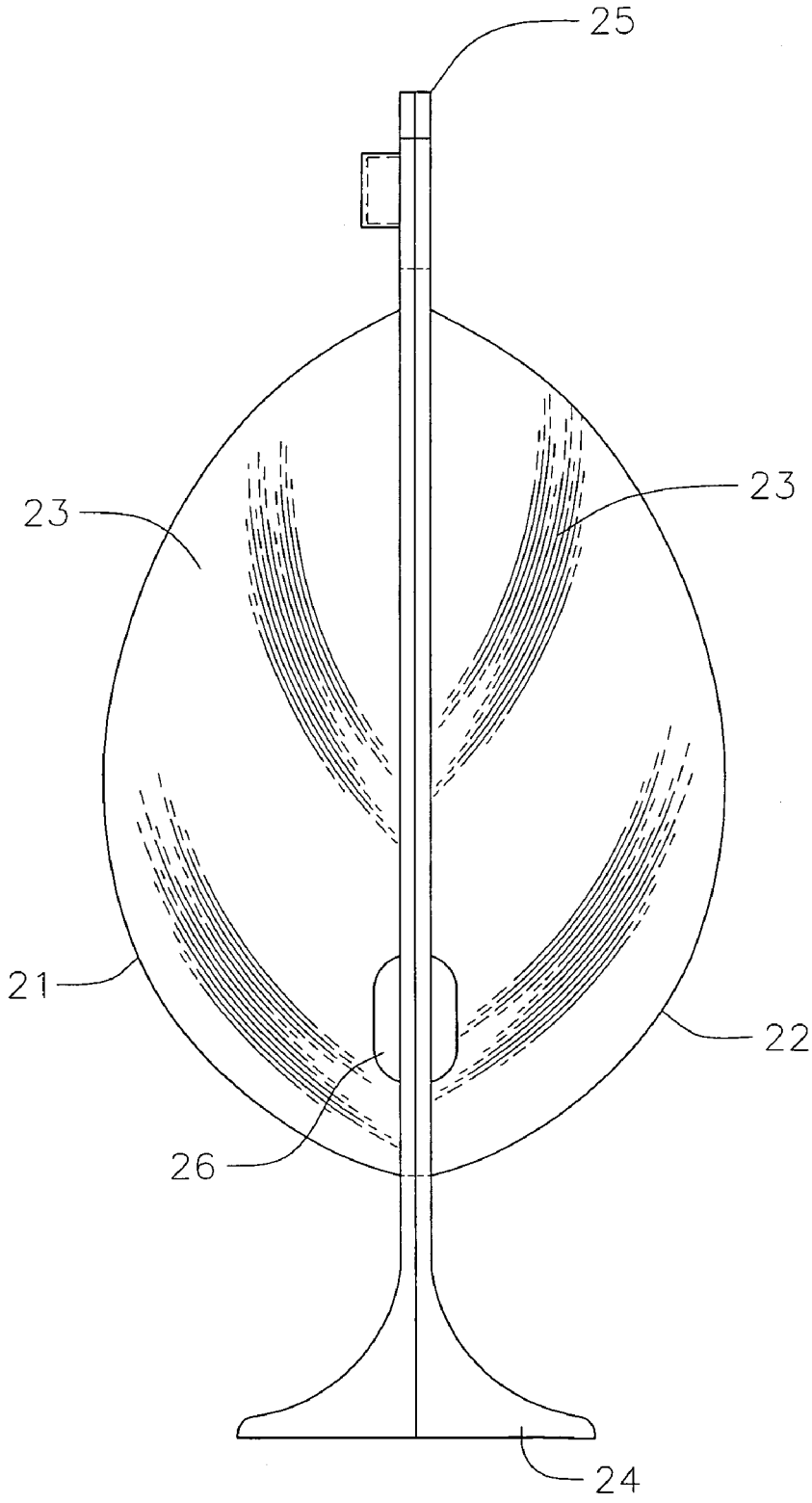
FIG. 6 is a side view of a bra storing case according to another embodiment of the present invention in folded condition, illustrating the inner sides of the bra storing case with a width as a seat for placing it uprightly in folded condition.

Referring to FIG. 6, a width of inner sides 24 of the left and right casings 21,22 has been designed. Thus by folding the left and right casings 21,22, the inner sides 24 can be used as a seat for placing uprightly.

Thereby certain embodiments of the present invention have one or more of the following advantages:

1. The bra storing case is made of transparent plastic material. It has an advantage of being lightweight and of small volume. It is suitable for displaying and placing on a dressing table.

2. When the bra storing case according to certain embodiments of this invention is folded, the volume is small and is easy to carry. It is suitable for packing in luggage to travel and has the advantages of being carried with ease.

3. The structure of certain embodiments of this invention avoids the adhesive layers of the strapless and backless bra sticking together and prevents them from being contaminated by dirt or miscellaneous objects. The clasping means and the protrusions for exerting a force are simple for operation.

As stated in the above disclosed, certain embodiments of the present invention can surely achieve its expected objects to provide a bra storing case with small volume, lightweight for carrying with ease. The construction of the storing case is simple and is convenient for use; it has its industrial practical value. Having thus described my invention, what I claim as new and desire to be secured by Letters Patent of the United States are:

What is claimed is:

1. A bra storing case, comprising:

a left casing and a right casing, each of them having respectively a breast contour concave that is symmetrical to each other for storing breast cups, inner sides of said left and right casings being connected together to form a foldable shape; when the bra storing case is folded, the interior surfaces of said stored breast cups being covered completely, lateral sides of said left and right casings having disposed thereon a clasping means; after being folded, said left and right casings being clasped by said clasping means, said breast contour concaves protruding outward from the exterior surfaces of said left and right casings.

2. The bra storing case of claim 1, wherein the clasping means includes at least a set of clasping hole and embedding portion, said clasping hole and said embedding portion are respectively integrally formed with said left and right casings.

3. The bra storing case of claim 2, wherein said embedding portion and clasping hole are engaged with each other by an interference fit.

4. The bra storing case of claim 1, wherein said clasping means includes at least a male clasp and a female clasp, said male clasp and said female clasp are respectively disposed on said left casing and said right casing.

5. The bra storing case of claim 1, wherein the outer side of said clasping means forms extension portions for separating said left and right casings or releasing clasping condition.

6. The bra storing case of claim 1, wherein lateral sides of said left and right casings are respectively disposed of interlaced protrusions for separating said left and right casings or releasing clasping condition.

7. The bra storing case of claim 1, wherein at least a lateral chamber is disposed next to said breast contour concave of said two casings for placing connectors or accessories.

8. The bra storing case of claim 1, wherein a width of the inner sides of said left and right casings has been designed as a seat for placing uprightly in folded condition.

9. The bra storing case of claim 1, wherein said bra storing case is a transparent plastic case.

10. The bra storing case of claim 1, wherein said breast cups are a kind of strapless, backless bra, wherein substantially the entire interior surface of each of breast cups comprises a pressure sensitive adhesive layer thereon.

* * * * *

UNITED STATES PATENT AND TRADEMARK OFFICE

CERTIFICATE OF CORRECTION

PATENT NO. : 7,163,605 B2
APPLICATION NO. : 10/865648
DATED : January 16, 2007
INVENTOR(S) : Chen It is certified that error appears in the above-identified patent and that said Letters Patent is hereby corrected as shown below:

On the Title Page

| | |
|---|---|
| Item (30) Foreign Application Priority Data | Insert --(30) Foreign Application Priority Data<br>Apr. 7, 2004 (TW) .....093119688<br>Apr. 13, 2004 (CN).....20040008954.9 |

Signed and Sealed this

Thirty-first Day of July, 2007

JON W. DUDAS
*Director of the United States Patent and Trademark Office*